US010641032B2

(12) United States Patent
Kendall et al.

(10) Patent No.: US 10,641,032 B2
(45) Date of Patent: May 5, 2020

(54) PROTECTIVE DEVICE FOR DOOR ASSEMBLY MEMBERS

(71) Applicant: Endura Products, Inc., Colfax, NC (US)

(72) Inventors: Adam Kendall, Burlington, NC (US); Tomasz Jaskiewicz, Oak Ridge, NC (US)

(73) Assignee: Endura Products, Inc., Colfax, NC (US)

( * ) Notice: Subject to any disclaimer, the term of this patent is extended or adjusted under 35 U.S.C. 154(b) by 144 days.

(21) Appl. No.: 15/945,965

(22) Filed: Apr. 5, 2018

(65) Prior Publication Data

US 2019/0309567 A1 Oct. 10, 2019

(51) Int. Cl.

| | |
|---|---|
| ***E06B 1/60*** | (2006.01) |
| ***E06B 1/34*** | (2006.01) |
| ***E06B 7/28*** | (2006.01) |
| ***E06B 7/23*** | (2006.01) |
| ***E06B 1/68*** | (2006.01) |
| ***E06B 7/26*** | (2006.01) |
| ***E06B 1/64*** | (2006.01) |

(52) U.S. Cl.

CPC ..... *E06B 1/6069* (2013.01); *E06B 1/34* (2013.01); *E06B 1/64* (2013.01); *E06B 1/68* (2013.01); *E06B 7/2316* (2013.01); *E06B 7/26* (2013.01); *E06B 7/28* (2013.01); *E05Y 2900/132* (2013.01); *E05Y 2900/148* (2013.01)

(58) Field of Classification Search

CPC . E06B 1/6069; E06B 1/68; E06B 1/64; E06B 1/34; E06B 7/26; E06B 7/2316

USPC ..... 52/126.1, 126.3; 49/380

See application file for complete search history.

(56) References Cited

U.S. PATENT DOCUMENTS

| | | | | |
|---|---|---|---|---|
| 1,620,933 A | | 3/1926 | Wilcox | |
| 2,651,814 A | * | 9/1953 | Lester, Jr. | E06B 1/08 49/380 |
| 3,324,598 A | * | 6/1967 | Tinfow | E06B 7/2316 49/482.1 |
| 3,501,866 A | * | 3/1970 | Johnson | E06B 1/70 49/380 |
| 4,174,862 A | | 11/1979 | Shane | 292/346 |
| 4,330,972 A | * | 5/1982 | Sailor | E06B 1/32 49/504 |
| 4,731,965 A | | 3/1988 | Jensen | 52/126.1 |
| 4,887,407 A | | 12/1989 | Nelson | 52/745 |
| 5,469,666 A | | 11/1995 | Lewis, Jr. | 49/471 |
| 5,655,342 A | * | 8/1997 | Guillemet | E06B 1/60 49/505 |

(Continued)

FOREIGN PATENT DOCUMENTS

| | | | | |
|---|---|---|---|---|
| FR | 2918406 A1 * | 1/2009 | ..... | E06B 7/2316 |

*Primary Examiner* — Marcus Menezes

(74) *Attorney, Agent, or Firm* — MacCord Mason PLLC

(57) ABSTRACT

A protective device and method for protection of a door frame member and/or door assembly. The protective device may include a body portion and an adjoining flange portion. The body portion may include a free side and a corner side running parallel to each other and may form an L-shaped device. The flange may include guide slot openings for placement of a fastener through the openings. The body portion may have a substantially planar top and a curved bottom with reduced portions forming attachment areas for securing the protective device removably to a door assembly.

17 Claims, 9 Drawing Sheets

(56) References Cited

U.S. PATENT DOCUMENTS 5,655,343 A 8/1997 Seals ..... 52/217
5,799,443 A 9/1998 Koeniguer ..... 49/383
5,815,998 A 10/1998 Wamsher ..... 52/211
6,018,916 A 2/2000 Henry ..... 52/126.1
6,293,064 B1 * 9/2001 Larson ..... E04B 1/762 52/209
6,357,187 B1 3/2002 Haldeman ..... 52/211
6,357,200 B1 3/2002 Vanderpan ..... 52/745.16
6,551,690 B2 4/2003 Dwinell ..... 428/156
6,725,604 B1 4/2004 Vanderpan ..... 49/380
7,059,087 B2 * 6/2006 Allen ..... E06B 1/62 52/204.1
7,204,059 B2 * 4/2007 Schiffmann ..... E04G 21/30 49/460
7,310,916 B2 12/2007 Gorman ..... 52/126.1
7,814,716 B2 * 10/2010 Moffatt ..... E06B 1/6015 204/213
8,397,469 B2 * 3/2013 Temnyenkov ..... E06B 5/12 52/745.15
8,621,795 B2 1/2014 Peterson ..... 52/213
8,813,437 B1 8/2014 Spofford ..... 52/126.1
9,273,480 B2 * 3/2016 Larochelle ..... E04G 23/0277
9,790,731 B1 * 10/2017 Bishman ..... E06B 1/6069
9,803,413 B2 10/2017 MacDonald ..... 52/204.1
2002/0170189 A1 11/2002 Cheatham ..... 33/194
2005/0178079 A1 8/2005 Hardman et al. ..... 52/208
2011/0296777 A1 * 12/2011 Matta ..... E06B 1/342 52/208
2014/0093691 A1 4/2014 Shray et al. ..... 428/156
2015/0275565 A1 * 10/2015 Rasmussen ..... E06B 1/02 52/204.1
2017/0204653 A1 * 7/2017 Mitchell ..... E04F 21/0015
2019/0112863 A1 * 4/2019 Rocca, Jr. ..... E06B 1/02

* cited by examiner

PROTECTIVE DEVICE FOR DOOR ASSEMBLY MEMBERS

FIELD OF TECHNOLOGY

The present disclosure relates generally to protective devices for entranceways for example, for a building and, more particularly, to protective devices for a door assembly for a residence/facility and to door assembly frame members.

BACKGROUND

Frame components, such as jambs and mullions, along with thresholds and door panels, are assembled and installed as entranceways in buildings and residences. Door systems are often pre-assembled (pre-hung) in a factory prior to delivery to a job site. Pre-assembly of the frame members is often attempted without the use of guides for location of attachment fasteners. This manual assembly can lead to location errors of fasteners which can compromise joint integrity.

Further, the pre-hung door assembly can be shipped to and stored in multiple locations prior to arrival at the job site. This leads to handling of the door assembly multiple times. The shipping, multiple relocations, and storage of the pre-hung door assembly renders it subject to damage, particularly the bottom-most components which include side jambs.

Some efforts have been made to provide protective devices for the bottom-most components, however, such efforts have been directed toward permanently attached structures for placement during installation, protective devices that do not adequately protect the frame parts, create unacceptable expense, or hinder installation and cause excessively long processing times. Conventional devices, by way of example, strips of wood and/or, heavy duty cardboard do not assist with proper placement of components during the assembly process.

Thus, Applicant recognized there remains a need for a new and improved protective device for door assemblies and frame members and it is to these and other challenges that the inventions of the present disclosure are directed.

SUMMARY

The present disclosure is directed in one embodiment to a protective support for a door frame member. One embodiment may include a protective support device for attachment to the bottom of a door frame member including a body portion and an adjoining flange portion. The body portion may include a free side and a corner side running parallel to each other and to an Axis A. The body portion may adjoin the flange portion along the corner side. One example may include at least one longitudinal guide slot spanning from a back of the flange through to a front of the flange. An opening in the flange may be provided and configured to serve as a guide for placement of a fastener through the openings. The support device in some embodiments is configured to mate with the door frame member at a corner and is removed prior to installation.

In some examples, the protective support device body portion may include a top and a bottom. The top may include a substantially planar surface. The bottom may include a substantially curved surface. The substantially planar surface may include recesses. The recesses may recess into the substantially planar surface. The substantially curved surface may also include recesses into the inside of the substantially curved bottom.

The bottom may include a first ramped end and a second ramped end. The bottom may extend longitudinally between the first and second ramped ends. The bottom may extend away from the substantially planar surface to form an apex along the most distal part of the substantially curved bottom.

The first and second ramped ends may be tapered toward each other and away from a respective first bottom end and a second bottom end.

In some embodiments, the support device may form an L-shaped support sized to mate with the bottom end of a side jamb. The support deice body may include a planar top portion and an arced bottom portion with a set of tapered ends that taper inwardly toward one another.

Other embodiments may include a protective support device for attachment to the bottom of a door frame side jamb including a body portion and an adjoining flange portion. The body portion may include a free side, a corner side, a first end, a second end, a top and a bottom. The free side and the corner side may run parallel to each other and to an Axis A. The body portion may adjoin the flange portion along the corner side. The top may have a substantially planar surface. The bottom may include ramped ends at the first end and at the second end. There may be a radiused surface between the ramped ends. The flange portion may include at least one guide slot spanning from a back of the flange through to a front of the flange. There may be an opening in the flange configured to serve as a guide for placement of a fastener through the openings.

Inward recesses in the radiused surface may form an attachment area for temporarily securing the support device to the door frame side jamb. The recesses may be a reduced portion. The attachment area may include a flat surface between the top and the bottom on which fasteners may be secured and the fasteners may pass through to secure the support device to the door frame side jamb.

Examples may include a protective device for a door assembly. The protective device for a door assembly may include any of the embodiments disclosed herein. The protective device may be fitted with the bottom-most components of a pre-hung door system to protect the frame members and assembly during shipping, transport and storage.

Inventions of the present disclosure may also be considered a method for protection of a door frame member by way of any of the embodiments disclosed. By way of example, a method for protection of a door frame member may include mating an L-shaped protective support device having a body portion and an adjoining flange portion to a bottom end of a door frame member, aligning the flange portion with an outside end of frame member, aligning the body portion with a lower end of the frame member, securing the support device to the door frame member with a detachable fastener, leaving the protective support device affixed during transport of a pre-hung door assembly, and removing the support device prior to installation of the door assembly into a rough opening.

A guide slot may be used to position fasteners to attach the frame member to a threshold prior to removal of the support device. The lower end of the frame member may be covered with a curved bottom of the body portion.

These and other aspects of the inventions of the present disclosure will become apparent to those skilled in the art after a reading of the following description of embodiments when considered with the drawings.

DESCRIPTION OF EMBODIMENTS

Figure 1:
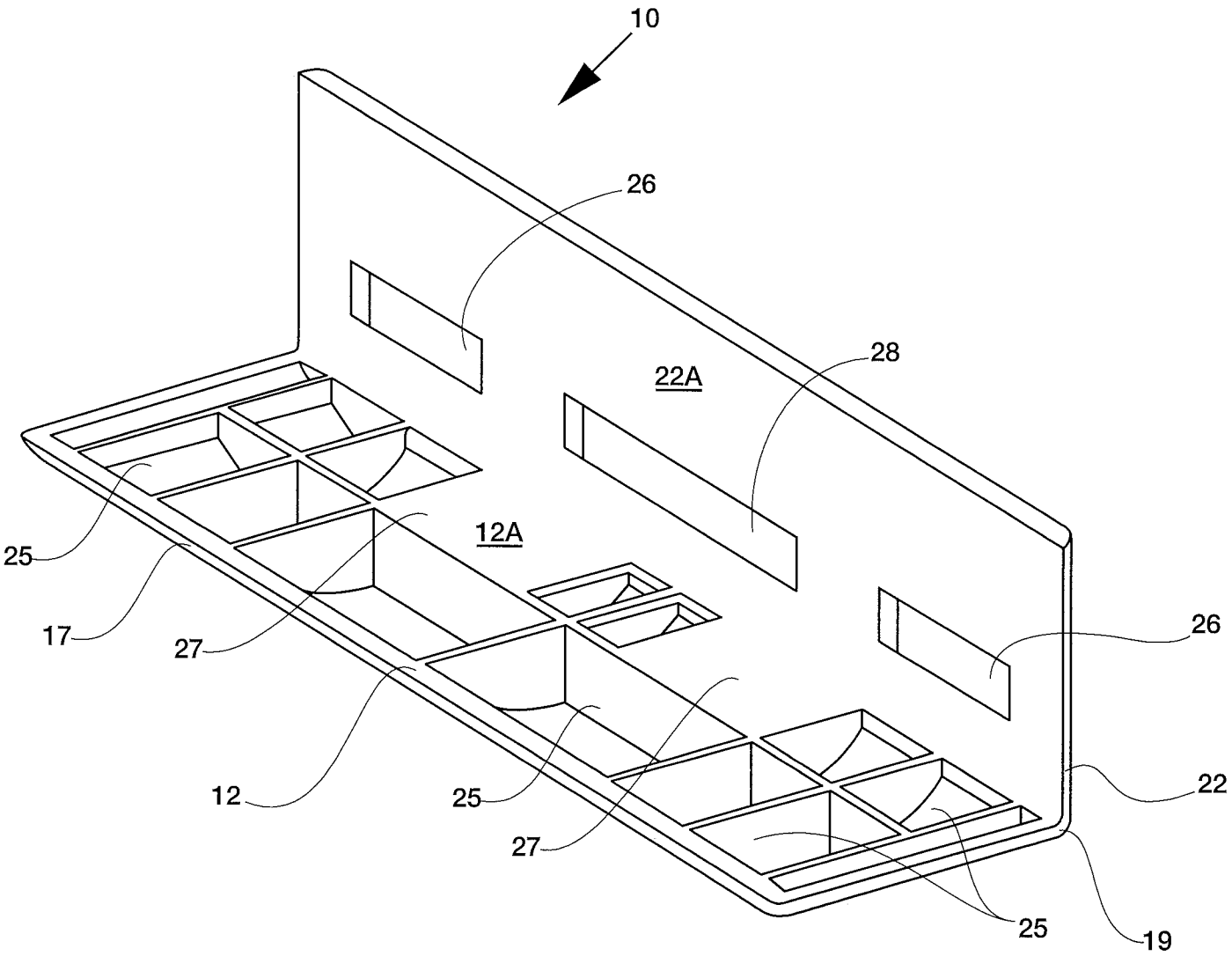
FIG. 1 is a front perspective view of one embodiment of a protective device for a door assembly constructed according to the present disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
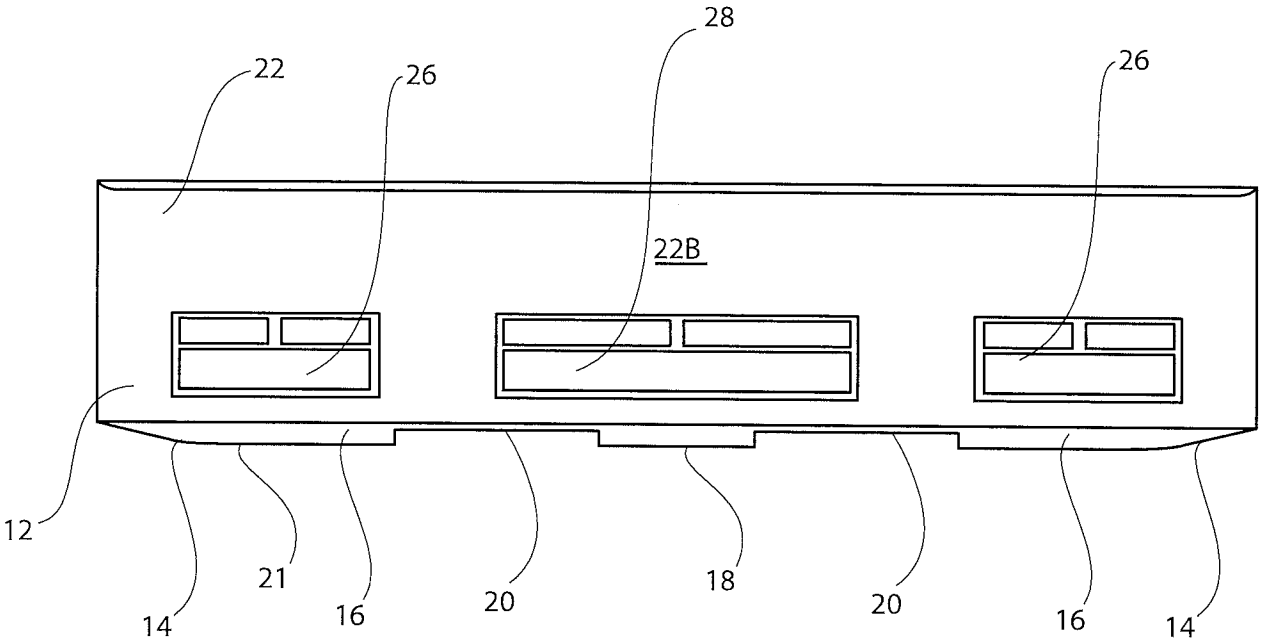
FIG. 2 is back view of one embodiment of a protective device for a door assembly constructed according to the present disclosure.

Referring now to the drawings in general and FIGS. 1 and 2 in particular, it will be understood that the illustrations are for the purpose of describing a preferred embodiment of the inventions and are not intended to limit the inventions thereto. FIG. 1 shows, a protective support device, generally designated 10, constructed according to embodiments of the present disclosure. Protective support device 10 may be considered a protective support device for a frame member. The frame member may be a window frame member, and/or, by way of example, a door frame member such as a door jamb.

One embodiment may include the protective support device 10 for attachment to the bottom of a door frame member including a body portion 12 and an adjoining flange portion 22. The body portion 12 may include a free side 17 and a corner side 19 running parallel to each other and to an Axis A (see FIG. 4). The body portion 12 may adjoin the flange portion 22 along the corner side 19. One example may include at least one longitudinal guide slot 28 spanning from a back 22B of the flange through to a front of the flange 22A. The guide slot 28 may be an opening in the flange provided and configured to serve as a guide for placement of a fastener through the opening.

Some embodiments may include more than one guide slot. Guide slots may include, by way of example, a mid-guide slot 28 and/or one or more end guide slot 26. One example includes an elongated end guide slot 26 providing an opening toward one end of the flange, an elongated end guide slot 26 toward a distal end of the flange and a mid-guide slot 28 arranged in line with and between the two end guide slots 26, with each of the guide slots 26, 28, 26 spaced apart from each other by portions of the flange 22. The support device 10 in some embodiments is configured to mate with the door frame member at a frame member corner and is removed from the frame member corner prior to installation.

The flange 22 guide slots 26, 28 may indicate proper position for fasteners used to attach side jambs to a sill/threshold. Fasteners may typically include crown-type staples, by way of example, but could also include screws, and/or nails. Fasteners may be used through the flange 22 and/or through the guide slots 26, 28 to attach the support device 10 to a jamb side face prior to door unit assembly. The support device 10 may be sized for accurate placement and coverage on the bottom end of a door jamb.

Embodiments may include where the protective support device body portion 12 may include a top 12A and a bottom 12B. The top 12A may include a substantially planar surface. The bottom 12B may include a substantially curved surface. The substantially planar surface may include recesses 25. The recesses 25 may recess into the substantially planar surface. The substantially planar surface may be a framework including a frame having recesses 25 inlaid in the frame.

The substantially curved surface may also include recesses into the inside of the substantially curved bottom 12B. The recesses in the substantially curved bottom may be considered reduced portions 20. The reduced portions 20 may include openings and/or may be portions reduced and recessed into the substantially curved bottom. The reduced portions 20 may include cutaways recessed into the substantially curved bottom at approximately a 90 degree angle. The cutaways may be at between an 85 degree and 95 degree angle in some examples. The reduced portions 20 may be recessed on the bottom 12B and may form planar faces 27 on the top 12A to be apart of the planar surface.

The bottom 12B may include a first ramped end 14 and a second ramped end 14. The ramped ends may terminate the bottom 12B on each end. The ramped ends 14 may face away from each other at distal ends of the bottom 12B. The bottom 12B may extend longitudinally between the first and second ramped ends 14. The bottom 12B may extend away from the substantially planar surface to form an apex along the most distal part of the substantially curved bottom. An axis A may run along the apex.

The first and second ramped ends may be tapered toward each other and away from a respective first bottom end and a second bottom end. The ramped ends and substantially curved surface of bottom 12B facilitate ease of overcoming encountered obstacles, reduced friction against obstacles and encourage the frame member to slide smoothly across encountered obstacles without damage to the frame member during door assembly transportation, handling prior to installation.

Figure 5:
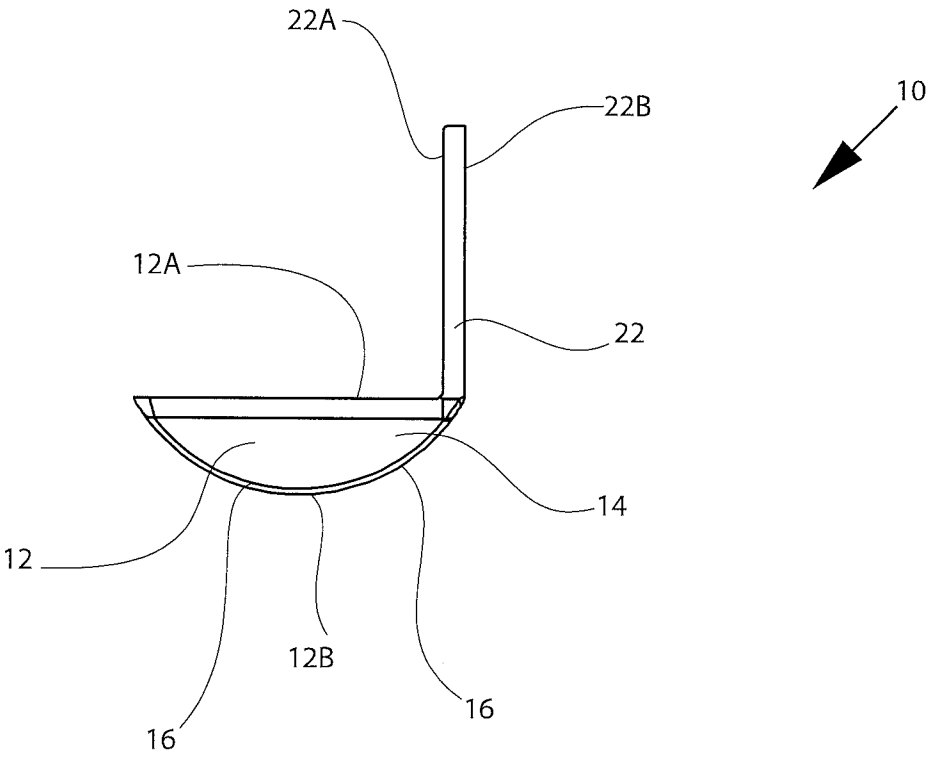
FIG. 5 is an end view of one example of the protective device of FIG. 2.
Figure 6:
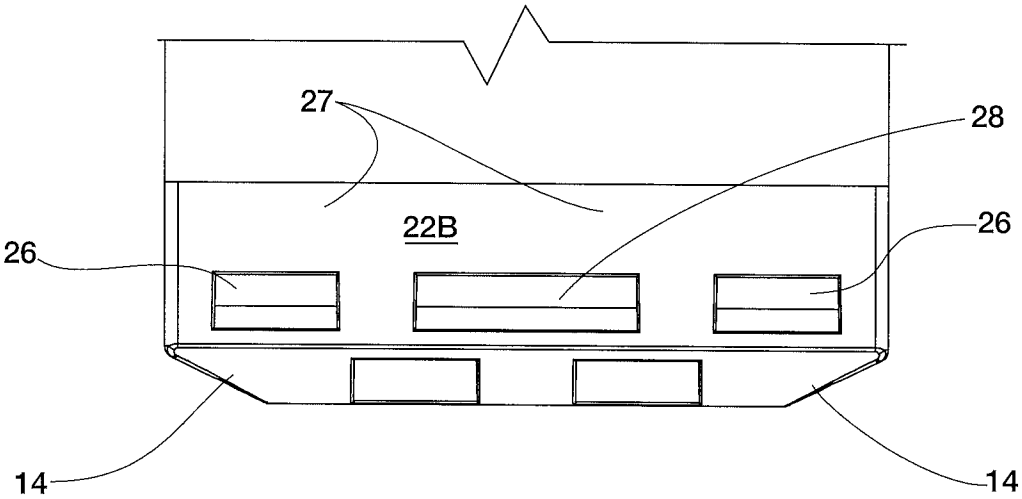
FIG. 6 shows one example of a protective device for a door frame member attached to a door assembly constructed according to the present disclosure.

In some embodiments, the support device 10 may form an L-shaped support sized to mate with the bottom end of a side jamb frame member 40 as seen in FIGS. 5 and 6. The support device body 12 may include a planar top portion 12A and an arced bottom portion 12B with a set of tapered ends 14 that taper inwardly toward one another toward the apex of the bottom 12B. The tapered ends 14 may have faces that face away from each other and project outwardly from the apex, upwardly toward the bottom ends. In one example, the tapered ends 14 may be tapered inwardly at an angle of between 60 degrees and 70 degrees from an end of the bottom 12B.

Figure 7:
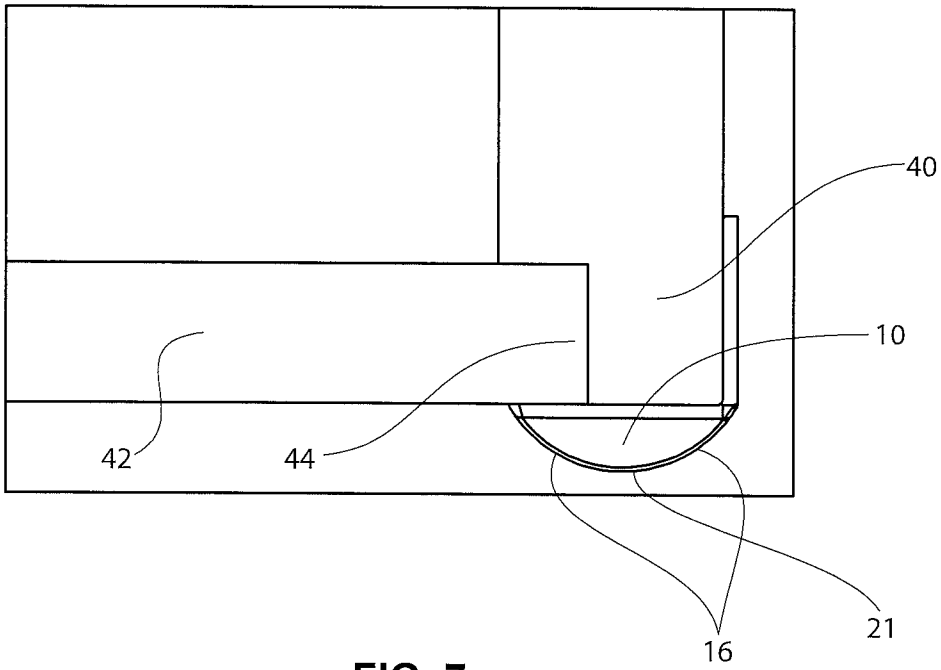
FIG. 7 is an end view showing one example of a protective device attached to a door assembly constructed according to the present disclosure.
Figure 8:
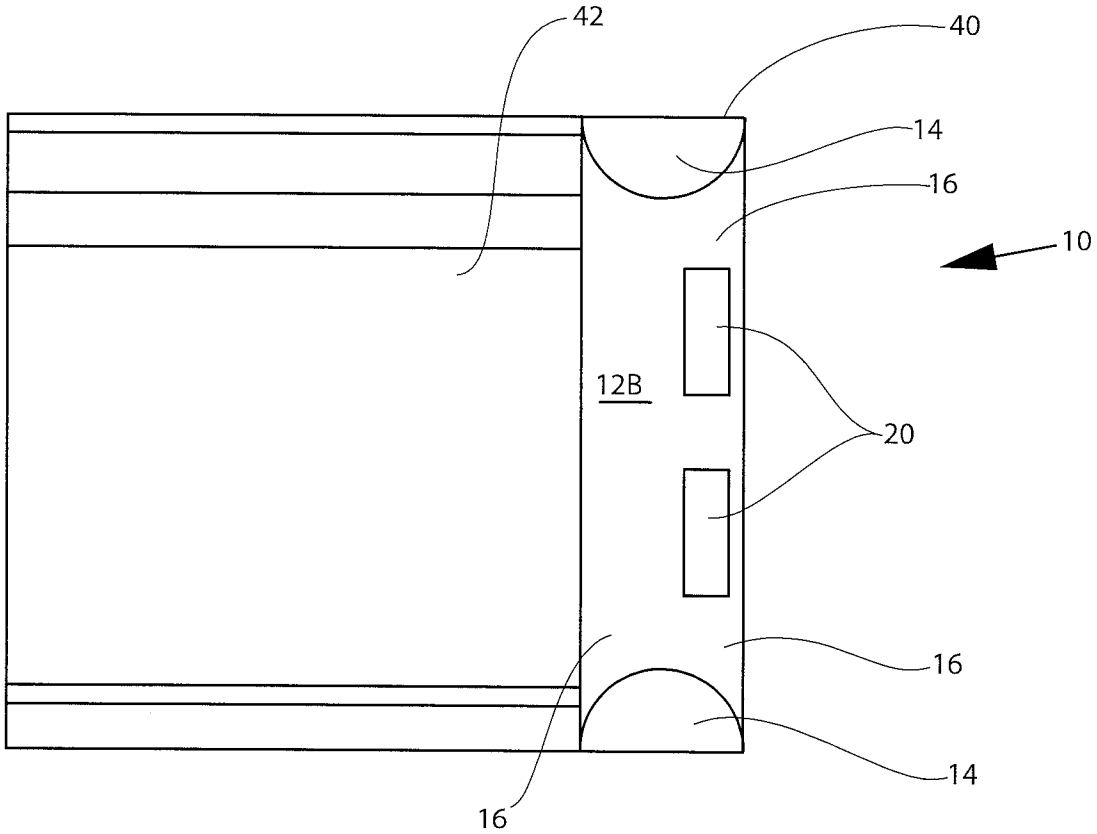
FIG. 8 is a bottom view showing one example of a protective device attached to a door assembly constructed according to the present disclosure.
Figure 9:
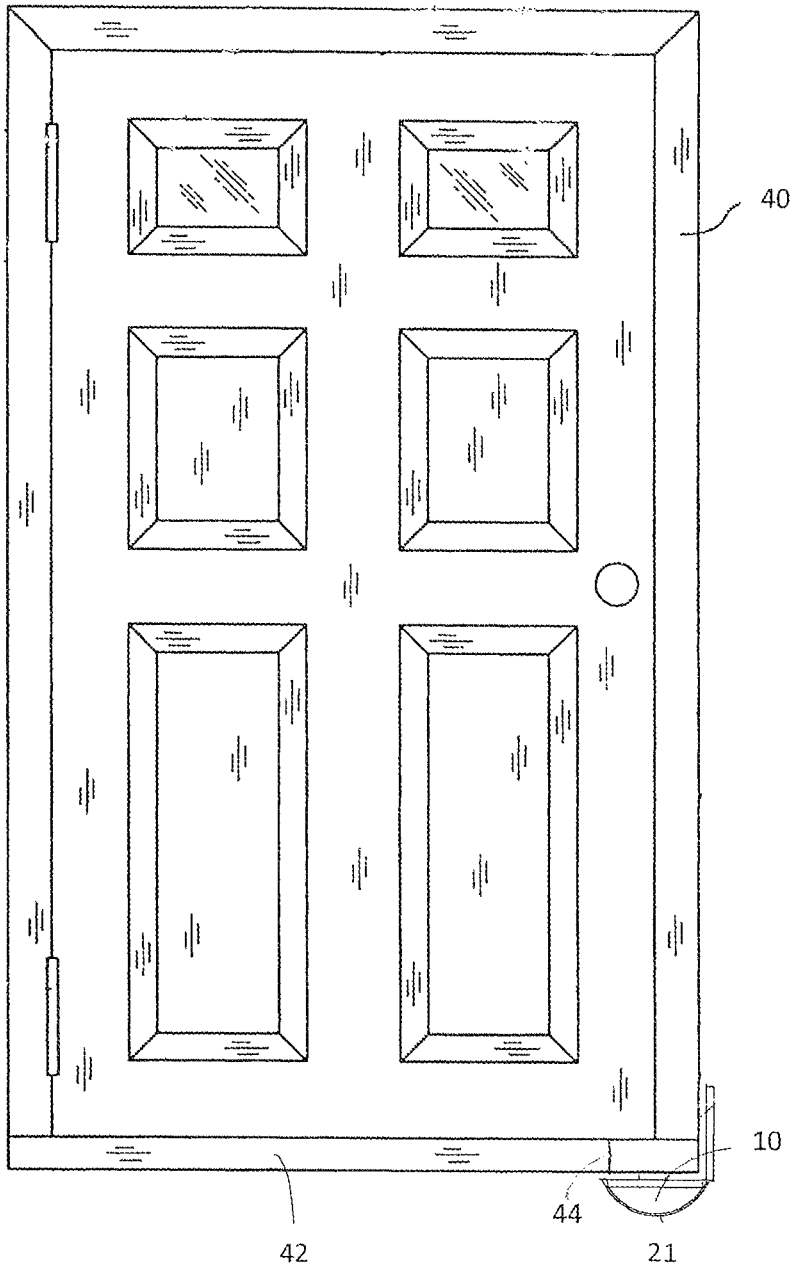
FIG. 9 is a view of the protective device attached to a door assembly constructed according to the present disclosure.

In FIGS. 7 and 8, the support device 10 is attached to a frame member for an assembly for a door frame at a sill end 44. The sill 42 may perpendicularly meet at the sill end 44 with a frame member 40, by way of example a door jamb.

The support device 10 may overlap with the frame member 40 and a sill 42 at installation, prior to being removed. The flange 22 may support and protect the frame member 40 on one side, while the body 12 supports and protects the frame member 40 on a bottom side. The guide slots 26, 28 allow for assembly attachment guidance and options while the support device 10 is attached to the frame member 40. The support device 10 may then be removed without disturbing the frame member attachment to the door assembly.

A door frame may include one or more frame members. A plurality of frame members may include any combination of a header and a pair of side jambs. A header may be generally placed toward the top of the door panel. Side jambs and may be generally placed at opposing sides of the door panel. However, in some embodiments, the side jambs are not directly adjacent to the door panel. A door panel may further include hinges. Hinges may connect the door panel to at least one of the frame members. In another embodiment, hinges may connect the door panel to a mullion. There may be three or more hinges.

Other embodiments may include a protective support device 10 for attachment to the bottom of a door frame side jamb including a body portion 12 and an adjoining flange portion 22. The body portion may include a free side 17, a corner side 19, a first end, a second end, a top 12A and a bottom 12B. The free side 17 and the corner side 19 may run parallel to each other and to an Axis A. The body portion 12 may adjoin the flange portion 22 along the corner side 19. The top 12A may have a substantially planar surface. The bottom 12B may include ramped ends 14 at the first end and at the second end. There may be a radiused surface 16 between the ramped ends. The flange portion 22 may include at least one guide slot 28 spanning from a back 22B of the flange 22 through to a front 22A of the flange. There may be an opening in the flange configured to serve as a guide for placement of a fastener through the openings.

Inward recesses in the radiused surface 16 may form an attachment area 20 for temporarily securing the support device 10 to a door frame side jamb. The attachment area 20 may be a reduced portion. The attachment area 20 may include a flat surface between the top 12A and the bottom 12B on which fasteners may be secured and the fasteners may pass through to secure the support device 10 to a door frame side jamb.

Figure 3:
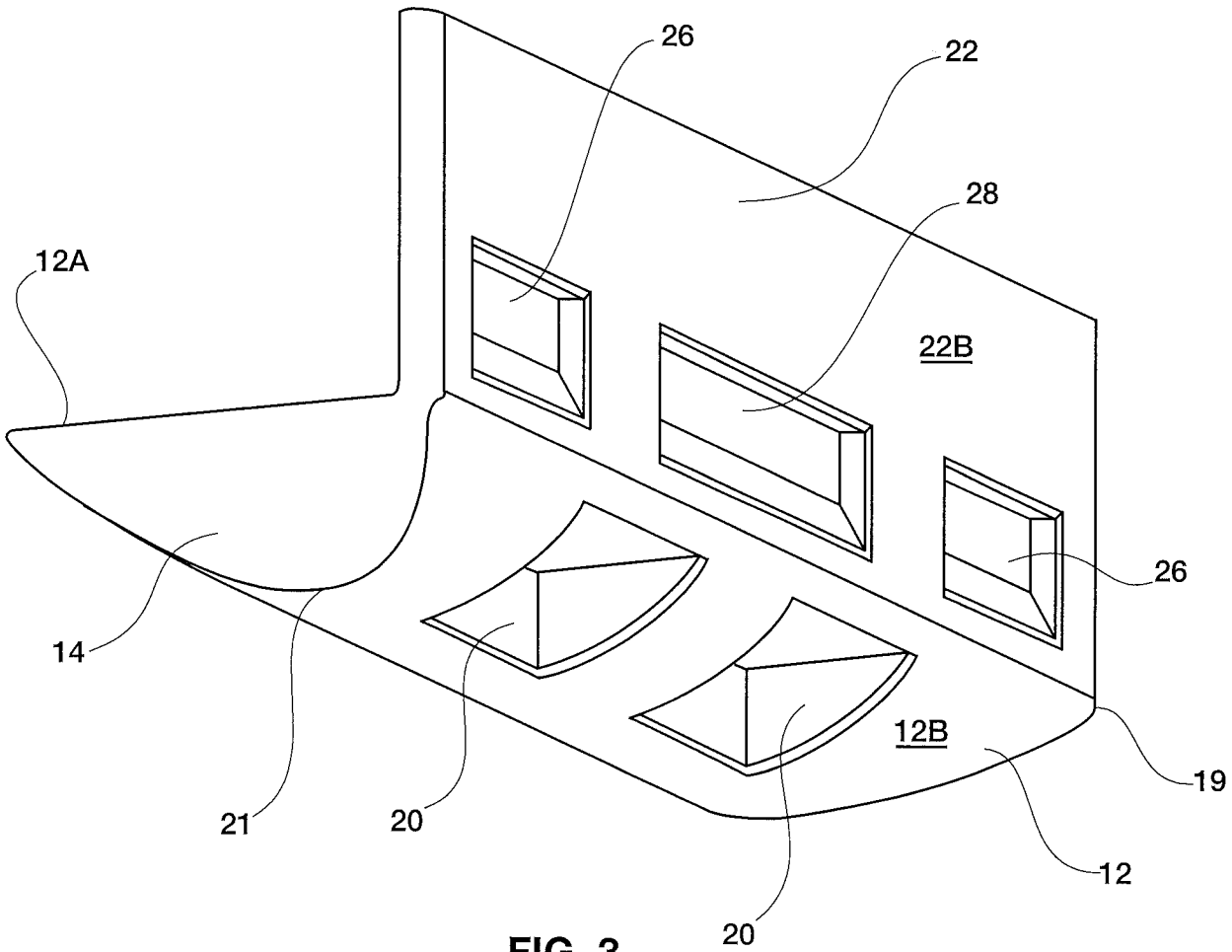
FIG. 3 is a back perspective view of one example of the protective device of FIG. 2.
Figure 4:
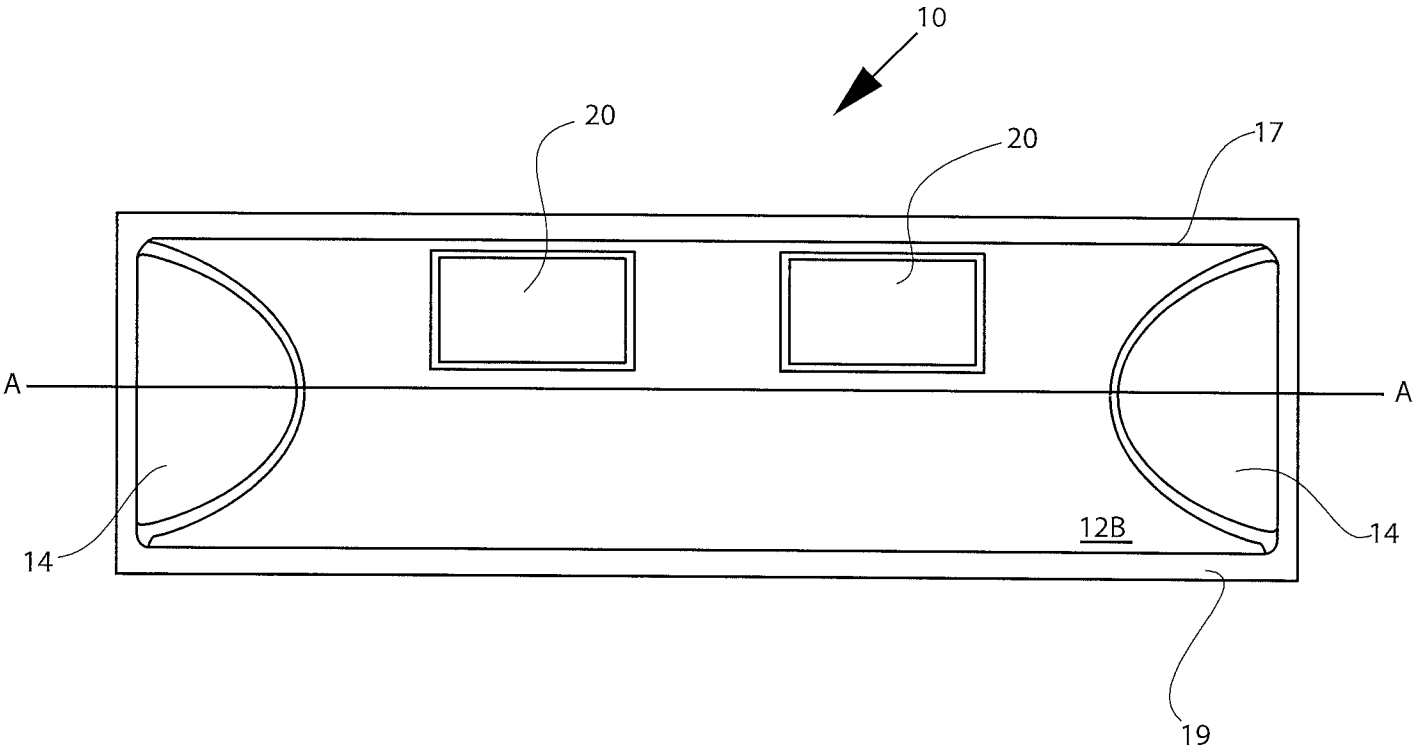
FIG. 4 is a bottom view of one example of the protective device of FIG. 2.

The radiused surface 16 may be divided by the reduced portions 20. There may be a middle radiused surface 18 and end radiused surfaces 16. The radiused surfaces 16, 18 may be separated by the reduced portions 20 in some examples. FIGS. 3 and 4 show the radiused surface peaking at an axis A and meeting the tapered ends 14 at an apex 21. The tapered ends 14 may take on a half oval shape with a vertex of the end 14 meeting with the apex 21 along the axis A.

An embodiment may be considered a protective device 10 for a door assembly. The protective device 10 for a door assembly may include any of the embodiments disclosed herein. The protective device may be fitted with the bottom-most components of a pre-hung door system to protect the frame members and assembly during shipping, transport and storage.

Inventions of the present disclosure may also be considered a method for protection of a door frame member by way of any of the embodiments disclosed. By way of example, a method for protection of a door frame member may include mating an L-shaped protective support device having a body portion 10 and an adjoining flange portion 22 to a bottom end of a door frame member, aligning the flange portion 22 with an outside end of frame member, aligning the body portion 12 with a lower end of the frame member, securing the support device 10 to the door frame member with a detachable fastener, leaving the protective support device affixed during transport of the door assembly, and removing the support device 10 prior to installation of the door frame member into a rough opening.

A guide slot 28, 26 may be used to position fasteners to attach the frame member to a threshold prior to removal of the support device 10. The lower end of the frame member may be covered with a curved bottom of the body portion. The guide slots 28, 26 allow that the support device 10 may therefore be removed at installation without disturbing attachment between the frame member 40 and sill 42. A bottom edge of the slot 28, 26 may be located to ensure that a fastener has sufficient offset from the bottom of a sill 42 substrate. Top and end edges of the slots 26, 27 may also be configured to provide limits to and guidance for intended fastener positioning.

In some embodiments, the support device 10 may be made of any material able to provide support and protection to the frame member to which it is attached, by way of example, wood, metal, and/or plastic. In some examples, the support device 10 is an injection molded support device. By way of example, the support device 10 may be made of a thermoplastic polymer such as polypropylene. In other examples, the support device 10 may be made of a high density polyethylene plastic, which provides durability, a low coefficient of friction surface and impact resistance to the device.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A protective support device for attachment to a bottom of a door frame member, comprising:

a body portion and an adjoining flange portion, wherein the body portion includes a free side and a corner side running parallel to each other and to an Axis A, the body portion adjoining the flange portion along the corner side, and at, least one longitudinal guide slot spanning from a back of the flange portion through to a front of the flange portion, and providing an opening in the flange portion configured to serve as a guide for placement of a fastener through the opening, and an arced bottom portion that is curved between the free side towards and to the corner side and extends from one ramped end to another ramped end, wherein the support device is configured to mate with the door frame member at a corner and is removed prior to installation.

2. The protective support device of claim 1 wherein the body portion and the flange portion adjoin at substantially a 90 degree angle.

3. The protective support device of claim 1 wherein the body portion includes a top and a bottom, the top having a substantially planar surface and the bottom being substantially curved.

4. The protective support device of claim 3 wherein the substantially planer surface includes recesses.

5. The protective support device of claim 4 wherein the recesses recess into an area on an inside of the substantially curved bottom.

6. The protective support device of claim 5 wherein the bottom includes a first ramped end and a second ramped end.

7. The protective support device of claim 6 wherein the substantially curved bottom extends longitudinally along Axis A between the first ramped end and the second ramped end.

8. The protective support device of claim 6 wherein the bottom extends away from the substantially planar surface to form an apex along the most distal part of the substantially curved bottom.

9. The protective support device of claim 6 wherein the first and second ramped ends are angled toward each other and away from a respective first bottom end and a second bottom end.

10. The protective support device of claim 3 wherein the support device forms an L-shaped support sized to mate with a bottom end of a side jamb.

11. The protective support device of claim 10 wherein the body of the support device body includes a planar top portion and the arced bottom portion with a set of tapered ends that are angled inwardly toward one another.

12. A protective support device for attachment to a bottom of a door frame side jamb, comprising:

a body portion and an adjoining flange portion, wherein the body portion includes:

a free side, a corner side, a first end, a second end, a top and a bottom, the free side and the corner side running parallel to each other and to an Axis A, the body portion adjoining the flange portion along the corner side, the top having a substantially planar surface, and the bottom including ramped ends at the first end and at the second end, and a radiused surface that curves and terminates at the free side and the corner side and extends lengthwise between the first end and the second end along the bottom between the ramped ends forming a nonpianar bottom, wherein the flange portion includes:

at least one guide slot spanning from a back of the flange portion through to a front of the flange portion, and providing an opening in the flange portion configured to serve as a guide for placement of a fastener through the opening.

13. The protective support device of claim 12 including an inward recess in the radiused surface.

14. The protective support device of claim 13 including more than one recess in the radiused surface.

15. The protective support device of claim 13 wherein the inward recess forms an attachment area for temporarily securing the support device to a door frame side jamb.

16. The protective support device of claim 15 wherein the recess is a reduced portion.

17. The protective support device of claim 16 wherein the attachment area includes a flat surface between the top and the bottom on which fasteners may be secured and pass through to secure the support device to the door frame side jamb.

* * * * *